US011248605B1

(12) United States Patent
Reinhart et al.

(10) Patent No.: US 11,248,605 B1
(45) Date of Patent: Feb. 15, 2022

(54) COMPRESSOR HAVING SHELL FITTING

(71) Applicant: Emerson Climate Technologies, Inc., Sidney, OH (US)

(72) Inventors: Keith J. Reinhart, Sidney, OH (US); Larry L. Bingham, Greenville, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 16/941,060

(22) Filed: Jul. 28, 2020

(51) Int. Cl.

| | |
|---|---|
| ***F04C 18/02*** | (2006.01) |
| ***F04C 29/04*** | (2006.01) |
| ***F04C 29/12*** | (2006.01) |
| ***F04B 39/12*** | (2006.01) |

(52) U.S. Cl.
CPC ..... *F04C 18/0215* (2013.01); *F04B 39/123* (2013.01); *F04C 29/042* (2013.01); *F04C 29/12* (2013.01); *F04C 2240/30* (2013.01); *F04C 2240/806* (2013.01); *F04C 2250/101* (2013.01)

(58) Field of Classification Search
CPC ..... F01C 1/0207–0292; F01C 21/18; F04C 18/0207–0292; F04C 2/025; F04C 15/06; F04C 29/12; F04C 2240/30; F04C 2240/806; F04C 2250/101; F04B 39/123
See application file for complete search history.

(56) References Cited

U.S. PATENT DOCUMENTS

| | | | |
|---|---|---|---|
| 1,365,530 | A | 1/1921 | Moore |
| 2,142,452 | A | 1/1939 | Merrill |
| 2,157,918 | A | 5/1939 | Rankin |
| 3,075,686 | A | 1/1963 | Steinhagen |
| 3,817,661 | A | 6/1974 | Ingalls et al. |
| 3,870,440 | A | 3/1975 | Zuercher, Jr. |
| 4,313,715 | A | 2/1982 | Richardson, Jr. |
| 4,343,599 | A | 8/1982 | Kousokabe |
| 4,365,941 | A | 12/1982 | Tojo et al. |

(Continued)

FOREIGN PATENT DOCUMENTS

| | | | |
|---|---|---|---|
| CN | 1208821 | A | 2/1999 |
| CN | 1278892 | A | 1/2001 |

(Continued)

OTHER PUBLICATIONS

U.S. Appl. No. 16/154,097, filed Oct. 8, 2018, Matthew Thomas Piscopo.

(Continued)

*Primary Examiner* — Laert Dounis
(74) *Attorney, Agent, or Firm* — Harness, Dickey & Pierce, P.L.C.

(57) ABSTRACT

A compressor includes a shell, a compression mechanism and a fitting. The shell includes an opening and defines a chamber. The compression mechanism is disposed within the chamber of the shell. The fitting is attached to the shell at the opening. Working fluid flowing through the fitting flows to the compression mechanism. The opening is partially defined by a first edge and a second edge. The first edge includes a first planar surface and the second edge includes a second planar surface that faces the first planar surface. A first portion of the fitting extends at least partially into the opening and a second portion of the fitting abuts against the first and second edges.

18 Claims, 5 Drawing Sheets

(56) References Cited

U.S. PATENT DOCUMENTS 4,401,418 A 8/1983 Fritchman
4,412,791 A 11/1983 Lal
4,477,229 A 10/1984 Kropiwnicki et al.
4,496,293 A 1/1985 Nakamura et al.
4,564,339 A 1/1986 Nakamura et al.
4,592,703 A 6/1986 Inaba et al.
4,609,334 A 9/1986 Muir et al.
4,648,811 A * 3/1987 Tahata ..... F04B 39/123 417/410.3
4,696,629 A 9/1987 Shiibayashi et al.
4,759,696 A 7/1988 Ishiai
4,767,293 A 8/1988 Caillat et al.
4,793,775 A 12/1988 Peruzzi
4,838,769 A 6/1989 Gannaway
4,877,382 A 10/1989 Caillat et al.
4,915,554 A 4/1990 Serizawa et al.
5,007,809 A 4/1991 Kimura et al.
5,030,073 A 7/1991 Serizawa et al.
5,055,010 A 10/1991 Logan
5,064,356 A 11/1991 Hom
5,108,274 A 4/1992 Kakuda et al.
5,114,322 A 5/1992 Caillat et al.
5,197,868 A 3/1993 Caillat et al.
5,219,281 A 6/1993 Caillat et al.
5,240,391 A 8/1993 Ramshankar et al.
5,288,211 A 2/1994 Fry
5,295,813 A 3/1994 Caillat et al.
5,306,126 A 4/1994 Richardson, Jr.
5,344,289 A 9/1994 Fasce
5,366,352 A 11/1994 Deblois et al.
5,427,511 A 6/1995 Caillat et al.
5,435,700 A 7/1995 Park
5,439,361 A 8/1995 Reynolds et al.
5,476,369 A 12/1995 Fowlkes et al.
5,531,078 A 7/1996 Day et al.
5,533,875 A 7/1996 Crum et al.
5,593,294 A 1/1997 Houghtby et al.
5,597,293 A 1/1997 Bushnell et al.
5,645,408 A 7/1997 Fujio et al.
5,745,992 A 5/1998 Caillat et al.
5,772,411 A 6/1998 Crum et al.
5,772,416 A 6/1998 Caillat et al.
5,931,649 A 8/1999 Caillat et al.
5,992,033 A 11/1999 Scarborough
6,000,917 A 12/1999 Smerud et al.
6,017,205 A 1/2000 Weatherston et al.
6,131,406 A 10/2000 Barowsky et al.
6,139,295 A 10/2000 Utter et al.
6,158,995 A 12/2000 Muramatsu et al.
6,164,934 A 12/2000 Niihara et al.
6,168,404 B1 1/2001 Gatecliff
6,174,150 B1 1/2001 Tsubone et al.
6,244,834 B1 6/2001 Matsuda et al.
6,261,071 B1 7/2001 Williams et al.
6,293,776 B1 9/2001 Hahn et al.
6,352,418 B1 3/2002 Kohsokabe et al.
6,364,643 B1 4/2002 Milliff
6,402,485 B2 6/2002 Hong et al.
6,454,538 B1 9/2002 Witham et al.
6,474,964 B2 11/2002 Bernardi et al.
6,537,019 B1 3/2003 Dent
6,685,441 B2 2/2004 Nam
6,709,244 B2 3/2004 Pham
6,736,607 B2 5/2004 Ginies et al.
6,814,546 B2 11/2004 Sekiguchi
6,857,808 B1 2/2005 Sugimoto et al.
6,887,050 B2 5/2005 Haller
6,896,496 B2 5/2005 Haller et al.
7,018,183 B2 3/2006 Haller et al.
7,018,184 B2 3/2006 Skinner et al.
7,063,523 B2 6/2006 Skinner
7,094,043 B2 8/2006 Skinner
7,108,494 B2 9/2006 Nam
7,137,775 B2 11/2006 Hopkins
7,147,443 B2 12/2006 Ogawa et al.
7,207,787 B2 4/2007 Liang et al.
7,311,501 B2 12/2007 Wehrenberg et al.
7,318,710 B2 1/2008 Lee et al.
7,416,395 B2 8/2008 Sato
7,503,755 B2 3/2009 Lai et al.
RE40,830 E 7/2009 Caillat
7,686,592 B2 3/2010 Inoue et al.
7,699,589 B2 4/2010 Terauchi et al.
7,708,536 B2 5/2010 Ginies et al.
7,771,180 B2 8/2010 Cho et al.
7,905,715 B2 3/2011 HIwata et al.
8,133,043 B2 3/2012 Duppert
8,152,503 B2 4/2012 Haller
8,348,647 B2 1/2013 Kiyokawa et al.
8,814,537 B2 8/2014 Ignatiev et al.
8,974,198 B2 3/2015 Schaefer et al.
8,992,186 B2 3/2015 Silveira et al.
9,051,934 B2 6/2015 Fraser
9,057,270 B2 6/2015 Strawn et al.
9,366,462 B2 6/2016 Perevozchikov et al.
10,094,600 B2 10/2018 Doepker et al.
2001/0006603 A1 7/2001 Hong et al.
2001/0055536 A1 12/2001 Bernardi et al.
2002/0090305 A1 7/2002 Myung et al.
2003/0072662 A1 4/2003 Reinhart
2004/0057843 A1 3/2004 Haller et al.
2004/0057849 A1 3/2004 Skinner et al.
2004/0057857 A1 3/2004 Skinner
2004/0126258 A1 7/2004 Lai et al.
2004/0166008 A1 8/2004 Lai et al.
2004/0228751 A1 11/2004 Shin
2005/0129534 A1 6/2005 Lee
2006/0073061 A1 * 4/2006 Sato ..... F04C 23/008 418/149
2006/0078452 A1 4/2006 Park et al.
2006/0127262 A1 6/2006 Shin et al.
2006/0177335 A1 8/2006 Hwang et al.
2006/0222545 A1 10/2006 Nam et al.
2006/0222546 A1 10/2006 Lee et al.
2006/0245967 A1 11/2006 Gopinathan
2006/0275150 A1 12/2006 Barth
2007/0178002 A1 8/2007 HIwata et al.
2007/0183914 A1 8/2007 Gopinathan
2007/0237664 A1 10/2007 Joo et al.
2009/0110586 A1 4/2009 Brabek et al.
2009/0136344 A1 5/2009 Chen et al.
2009/0229303 A1 9/2009 Iversen et al.
2010/0021330 A1 1/2010 Haller
2012/0134859 A1 5/2012 Duppert
2012/0148433 A1 6/2012 Liang et al.
2013/0026749 A1 1/2013 O'Brien et al.
2013/0039792 A1 2/2013 Hiratsuka et al.
2013/0089451 A1 4/2013 Ahn et al.
2013/0108496 A1 5/2013 Nakai et al.
2013/0129549 A1 5/2013 Sakuda et al.
2016/0348675 A1 12/2016 Ishii et al.
2017/0002812 A1 * 1/2017 Duppert ..... F04C 29/12
2019/0041106 A1 2/2019 Piscopo
2019/0041107 A1 2/2019 Piscopo et al.
2020/0309124 A1 10/2020 King
2020/0392953 A1 12/2020 Stover et al.

FOREIGN PATENT DOCUMENTS

CN 1354326 A 6/2002
CN 1371444 A 9/2002
CN 1482365 A 3/2004
CN 1629476 A 6/2005
CN 1779244 A 5/2006
CN 1869443 A 11/2006
CN 101235932 A 8/2008
CN 101415947 A 4/2009
CN 102216617 A 10/2011
CN 202926625 U 5/2013
CN 203453064 U 2/2014
CN 104976448 A * 10/2015
CN 104999172 A 10/2015
CN 204934897 U 1/2016
CN 205064214 U 3/2016

(56) References Cited

FOREIGN PATENT DOCUMENTS

| | | | | |
|---|---|---|---|---|
| CN | 107246393 | A | | 10/2017 |
| EP | 0438243 | A1 | | 7/1991 |
| EP | 0529660 | A1 | | 3/1993 |
| EP | 1338795 | A1 | | 8/2003 |
| EP | 1541868 | A1 | | 6/2005 |
| JP | S62182486 | A | | 8/1987 |
| JP | S63183773 | A | | 7/1988 |
| JP | H04347387 | A | | 12/1992 |
| JP | H05157064 | A | | 6/1993 |
| JP | H05302581 | A | | 11/1993 |
| JP | H07197893 | A | | 8/1995 |
| JP | H08319965 | A | | 12/1996 |
| JP | H11141470 | A | | 5/1999 |
| JP | 2001165065 | A | | 6/2001 |
| JP | 2002155875 | A | | 5/2002 |
| JP | 2002155877 | A | | 5/2002 |
| JP | 2002235524 | A | | 8/2002 |
| JP | 2003120539 | A | | 4/2003 |
| JP | 2004150370 | A | * | 5/2004 |
| JP | 2005188353 | A | | 7/2005 |
| JP | 2006144729 | A | | 6/2006 |
| JP | 2008223605 | A | | 9/2008 |
| JP | 2009019570 | A | | 1/2009 |
| JP | 2010043627 | A | | 2/2010 |
| JP | 2011236861 | A | | 11/2011 |
| KR | 20010064538 | A | | 7/2001 |
| KR | 20010068323 | A | | 7/2001 |
| KR | 20020024708 | A | | 4/2002 |
| KR | 20080019509 | A | | 3/2008 |
| KR | 20090045352 | A | | 5/2009 |
| KR | 20140034345 | A | | 3/2014 |
| KR | 20180107482 | A | | 10/2018 |
| KR | 20190025250 | A | | 3/2019 |
| WO | WO-2006109475 | A1 | | 10/2006 |
| WO | WO-2007025883 | A1 | | 3/2007 |
| WO | WO-2007114582 | A1 | | 10/2007 |
| WO | WO-2008102940 | A1 | | 8/2008 |
| WO | WO-2009090856 | A2 | | 7/2009 |
| WO | WO-2011147005 | A1 | | 12/2011 |

OTHER PUBLICATIONS

U.S. Appl. No. 16/154,364, filed Oct. 8, 2018, Matthew Thomas Piscopo et al.
U.S. Appl. No. 16/803,576, filed Feb. 27, 2020, Joshua S. King.
U.S. Appl. No. 15/930,785, filed May 13, 2020, Robert C. Stover et al.
International Search Report regarding International Application No. PCT/BR2010/000179, dated Sep. 1, 2010.
Written Opinion of the International Searching Authority regarding International Application No. PCT/BR2010/000179, dated Sep. 1, 2010.
International Search Report regarding International Application No. PCT/US2012/056067, dated Feb. 19, 2013.
Written Opinion of the International Searching Authority regarding International Application No. PCT/US2012/056067, dated Feb. 19, 2013.
Restriction Requirement regarding U.S. Appl. No. 13/610,274, dated Aug. 16, 2013.
Search Report regarding European Patent Application No. 10851912.5, dated Nov. 15, 2013.
Office Action regarding Japanese Patent Application No. 2013-511484, dated Nov. 19, 2013.
Office Action regarding U.S. Appl. No. 13/610,274, dated Nov. 27, 2013.
International Search Report regarding International Application No. PCT/US2013/059612, dated Dec. 9, 2013.
Written Opinion of the International Searching Authority regarding International Application No. PCT/US2013/059612, dated Dec. 9, 2013.
Office Action regarding U.S. Appl. No. 13/699,207, dated Dec. 18, 2013.
Notice of Allowance regarding U.S. Appl. No. 13/610,274, dated Mar. 24, 2014.
Notice of Allowance regarding U.S. Appl. No. 13/610,274, dated Jul. 18, 2014.
Office Action regarding European Patent Application No. 10851912.5, dated Jul. 18, 2014.
Office Action regarding U.S. Appl. No. 13/699,207, dated Jul. 24, 2014.
Office Action regarding Chinese Patent Application No. 201080066999.X, dated Sep. 17, 2014.
Notice of Allowance regarding U.S. Appl. No. 13/699,207, dated Nov. 24, 2014.
Office Action regarding Chinese Patent Application No. 201210376153.7, dated Dec. 3, 2014. Translation provided by Unitalen Attorneys At Law.
Restriction Requirement regarding U.S. Appl. No. 14/025,887, dated Jan. 5, 2015.
Restriction Requirement regarding U.S. Appl. No. 13/930,834, dated Jan. 29, 2015.
Office Action regarding U.S. Appl. No. 14/025,887, dated Mar. 26, 2015.
Notice of Allowance regarding U.S. Appl. No. 13/930,834, dated Apr. 24, 2015.
Office Action regarding Chinese Patent Application No. 201210376153.7, dated Jul. 3, 2015. Translation provided by Unitalen Attorneys at Law.
Office Action regarding U.S. Appl. No. 14/025,887, dated Jul. 23, 2015.
Office Action regarding Chinese Patent Application No. 201310286638.1, dated Jul. 27, 2015. Translation provided by Unitalen Attorneys at Law.
Office Action regarding U.S. Appl. No. 14/025,887, dated Decembers, 2015.
Office Action regarding Chinese Patent Application No. 201210376153.7, dated Dec. 28, 2015. Translation provided by Unitalen Attorneys at Law.
Office Action regarding Chinese Patent Application No. 201310286638.1, dated Jan. 21, 2016. Translation provided by Unitalen Attorneys at Law.
Office Action regarding Chinese Patent Application No. 201380047907.7, dated Mar. 8, 2016. Translation provided by Unitalen Attorneys at Law.
Notice of Allowance regarding U.S. Appl. No. 14/025,887, dated Apr. 12, 2016.
Search Report regarding European Patent Application No. 13836817.0, dated Jun. 1, 2016.
Office Action regarding Korean Patent Application No. 10-2012-7033723, dated Aug. 22, 2016.
Office Action regarding Chinese Patent Application No. 201380047907.7, dated Nov. 8, 2016. Translation provided by Unitalen Attorneys at Law.
Office Action regarding Chinese Patent Application No. 201380047907.7, dated Apr. 12, 2017. Translation provided by Unitalen Attorneys at Law.
Office Action regarding U.S. Appl. No. 15/180,570, dated Oct. 5, 2017.
Office Action regarding U.S. Appl. No. 15/180,570, dated Mar. 22, 2018.
Notice of Allowance regarding U.S. Appl. No. 15/180,570, dated May 31, 2018.
Notice of Allowance regarding U.S. Appl. No. 15/180,570, dated Jul. 19, 2018.
Office Action regarding Indian Patent Application No. 476/MUMNP/2015, dated Sep. 7, 2018.
Office Action regarding Indian Patent Application No. 10655/DELNP/2012, dated Sep. 28, 2018.
Office Action regarding European Patent Application No. 13836817.0, dated Sep. 10, 2019.
Office Action regarding U.S. Appl. No. 16/154,097, dated Jun. 23, 2020.
International Search Report regarding International Application No. PCT/US2020/025564, dated Jul. 8, 2020.

(56) References Cited

OTHER PUBLICATIONS

Written Opinion of the International Searching Authority regarding International Application No. PCT/US2020/025564, dated Jul. 8, 2020.
Office Action regarding U.S. Appl. No. 16/154,364, dated Aug. 17, 2020.
International Search Report regarding International Application No. PCT/US2020/037004, dated Sep. 21, 2020.
Written Opinion of the International Searching Authority regarding International Application No. PCT/US2020/037004, dated Sep. 21, 2020.
Notice of Allowance regarding U.S. Appl. No. 16/154,097, dated Oct. 27, 2020.
Notice of Allowance regarding U.S. Appl. No. 16/154,364, dated Jan. 6, 2021.

* cited by examiner

COMPRESSOR HAVING SHELL FITTING

FIELD

The present disclosure relates to a compressor having a shell fitting.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a compressor that includes a shell, a compression mechanism and a fitting (e.g., a suction fitting, a discharge fitting, or a fluid-injection fitting). The shell includes an opening and defines a chamber. The compression mechanism is disposed within the chamber of the shell. The fitting is attached to the shell at the opening. Working fluid flowing through the fitting flows to compression pockets of the compression mechanism. The opening is partially defined by a first edge and a second edge. The first edge includes a first planar surface and the second edge includes a second planar surface that faces the first planar surface. A first portion of the fitting extends at least partially into the opening and a second portion of the fitting abuts against the first and second edges.

In some configurations of the compressor of the above paragraph, the opening is a non-circular shape.

In some configurations of the compressor of any one or more of the above paragraphs, the opening has opposing arcuate surfaces. An outer diametrical surface of the fitting abuts against at least one of the opposing arcuate surfaces.

In some configurations of the compressor of any one or more of the above paragraphs, the opposing arcuate surfaces and the first and second edges define a circular shape.

In some configurations of the compressor of any one or more of the above paragraphs, the fitting is a suction fitting. Working fluid flowing through the suction fitting flows to the compression pockets of the compression mechanism.

In some configurations of the compressor of any one or more of the above paragraphs, the first portion of the fitting is a first portion of an axial end surface of the fitting and the second portion of the fitting is a second portion of the axial end surface of the fitting.

In some configurations of the compressor of any one or more of the above paragraphs, the opening has opposing arcuate surfaces. The opposing arcuate surfaces extend and the first and second edges define a circular shape.

In some configurations of the compressor of any one or more of the above paragraphs, the opening has opposing arcuate surfaces. Each of the first and second edges are disposed between the opposing arcuate surfaces.

In some configurations of the compressor of any one or more of the above paragraphs, the first and second edges prevent an outer diametrical surface of the fitting from contacting the first and second planar surfaces.

In some configurations of the compressor of any one or more of the above paragraphs, the first and second edges prevent the fitting from extending into the chamber of the shell.

In some configurations of the compressor of any one or more of the above paragraphs, the second portion of the fitting abuts against the first and second edges at a location external to the opening.

In some configurations of the compressor of any one or more of the above paragraphs, each of the opposing arcuate surfaces have a length that is greater than a length of each of the first and second planar surfaces.

In another form, the present disclosure provides a compressor that includes a shell, a compression mechanism and a fitting (e.g., a suction fitting, a discharge fitting, or a fluid-injection fitting). The shell includes an opening and defines a chamber. The compression mechanism is disposed within the chamber of the shell. The fitting is attached to the shell at the opening and at least partially disposed outside of the shell. Working fluid flows between the fitting and compression pockets of the compression mechanism. The opening is partially defined by a first edge having a first planar surface, a second edge having a second planar surface, and an arcuate surface disposed between the first and second planar surfaces. The first and second edges prevent the fitting from contacting the first and second planar surfaces and allow the fitting to contact the arcuate surface.

In some configurations of the compressor of the above paragraph, the opening has another arcuate surface that is opposite the arcuate surface. An outer diametrical surface of the fitting abuts against at least one of the opposing arcuate surfaces.

In some configurations of the compressor of any one or more of the above paragraphs, a first portion of the fitting extends at least partially into the opening and a second portion of the fitting abuts against the first and second edges at a location external to the opening.

In some configurations of the compressor of any one or more of the above paragraphs, the fitting includes a first axial end having a first thickness and a second axial end having a second thickness. The first thickness greater than the second thickness. The first axial end includes a first portion that extends at least partially into the opening and a second portion that contacts the first and second edges.

In some configurations of the compressor of any one or more of the above paragraphs, the first axial end has a first outer diametrical surface and the second axial end has a second outer diametrical surface. A first diameter of the first outer diametrical surface is greater than a second diameter of the second outer diametrical surface.

In some configurations of the compressor of any one or more of the above paragraphs, the fitting has a transition portion positioned between the first axial end and the second axial end and having a third outer diametrical surface. A third diameter of the third outer diametrical surface is smaller than the first and second diameters.

In some configurations of the compressor of any one or more of the above paragraphs, the fitting is made of steel and has a first axial end and a second axial end. The second axial end has a copper plating coating. The first axial end is attached to the shell.

In some configurations of the compressor of any one or more of the above paragraphs, each of the opposing arcuate surfaces have a length that is greater than a length of each of the first and second planar surfaces.

In yet another form, the present disclosure provides a compressor that includes a shell, a compression mechanism and a fitting (e.g., a suction fitting, a discharge fitting, or a fluid-injection fitting). The shell includes an opening and defines a chamber. The compression mechanism is disposed within the chamber of the shell. The fitting includes first and second opposing axial ends. The first axial end is attached to the shell at the opening and has a first outer diametrical surface and a first inner diametrical surface. The second axial end is disposed outside of the shell and has a second outer diametrical surface and a second inner diametrical surface. A first diameter of the first outer diametrical surface is greater than a second diameter of the second outer diametrical surface. A third diameter of the first inner diametrical surface is greater than the second diameter of the second outer diametrical surface and a fourth diameter of the second inner diametrical surface. The first axial end has a first thickness and the second axial end has a second thickness. The first thickness is greater than a second thickness.

In some configurations of the compressor of the above paragraph, the opening includes a first edge and a second edge that opposes the first edge. A first portion of the first axial end extends at least partially into the opening and a second portion of the first axial end abuts against the first and second edges.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
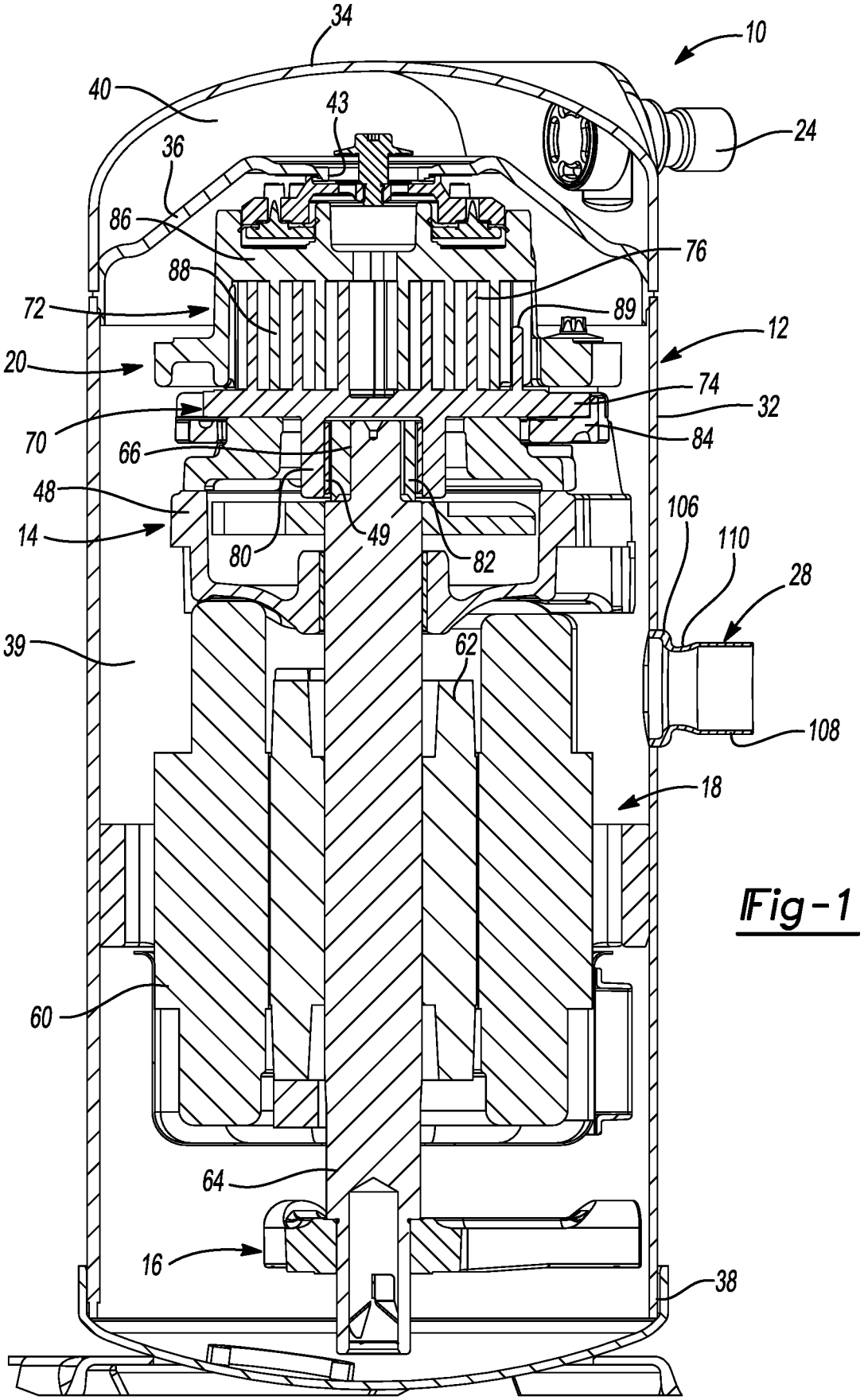
FIG. 1 is a cross-sectional view of a compressor having a suction fitting according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As shown in FIG. 1, a compressor 10 is provided and may include a hermetic shell assembly 12, first and second bearing housing assemblies 14, 16, a motor assembly 18, a compression mechanism 20, a discharge port or fitting 24 and a suction port or fitting 28.

As shown in FIG. 1, the shell assembly 12 may form a compressor housing and may include a cylindrical shell 32, an end cap 34 at an upper end thereof, a transversely extending partition 36, and a base 38 at a lower end thereof. The shell 32 and the base 38 may cooperate to define a suction-pressure chamber 39. The end cap 34 and the partition 36 may define a discharge-pressure chamber 40. The partition 36 may separate the discharge-pressure chamber 40 from the suction-pressure chamber 39. A discharge-pressure passage 43 may extend through the partition 36 to provide communication between the compression mechanism 20 and the discharge-pressure chamber 40.

The first bearing housing assembly 14 may be disposed within the suction-pressure chamber 39 and may be fixed relative to the shell 32. The first bearing housing assembly 14 may include a first main bearing housing 48 and a first bearing 49. The first main bearing housing 48 may house the first bearing 49 therein. The first main bearing housing 48 may fixedly engage the shell 32 and may axially support the compression mechanism 20.

As shown in FIG. 1, the motor assembly 18 may be disposed within the suction-pressure chamber 39 and may include a stator 60 and a rotor 62. The stator 60 may be press fit into the shell 32. The rotor 62 may be press fit on a drive shaft 64 and may transmit rotational power to the drive shaft 64. The drive shaft 64 may be rotatably supported by the first and second bearing housing assemblies 14, 16. The drive shaft 64 may include an eccentric crank pin 66 having a crank pin flat.

The compression mechanism 20 may be disposed within the suction-pressure chamber 39 and may include an orbiting scroll 70 and a non-orbiting scroll 72. The first scroll member or orbiting scroll 70 may include an end plate 74 and a spiral wrap 76 extending therefrom. A cylindrical hub 80 may project downwardly from the end plate 74 and may include the first bearing 49 and an unloader bushing 82 disposed therein. The crank pin flat may drivingly engage a flat surface in a portion of the inner bore to provide a radially compliant driving arrangement. An Oldham coupling 84 may be engaged with the orbiting scroll 70 and the bearing housing 48 to prevent relative rotation therebetween.

As shown in FIG. 1, the second scroll member or non-orbiting scroll 72 may include an end plate 86 and a spiral wrap 88 projecting downwardly from the end plate 86. The spiral wrap 88 may meshingly engage the spiral wrap 76 of the orbiting scroll 70, thereby creating a series of moving fluid pockets. The fluid pockets defined by the spiral wraps 76, 88 may decrease in volume as they move from a radially outer position (at a suction pressure) to a radially intermediate position (at an intermediate pressure) to a radially inner position (at a discharge pressure) throughout a compression cycle of the compression mechanism 20.

As shown in FIGS. 1-9, the suction fitting 28 may be a single, unitary component. The suction fitting 28 may provide working fluid at a suction-pressure from the suction fitting 28 to a suction inlet 89 of the non-orbiting scroll 72 so that the working fluid can be directed into the radially outermost fluid pocket and subsequently compressed by the compression mechanism 20. The suction fitting 28 may be axially misaligned with the suction inlet 89 of the non-orbiting scroll 72. For example, the suction fitting 28 may be disposed vertically lower than the suction inlet 89. The suction fitting 28 may be generally cylindrical and may be made of a metallic material (e.g., steel), for example. The suction fitting 28 may be attached to the shell 32 at an opening 90 thereof and may also extend at least partially into the opening 90.

Figure 3:
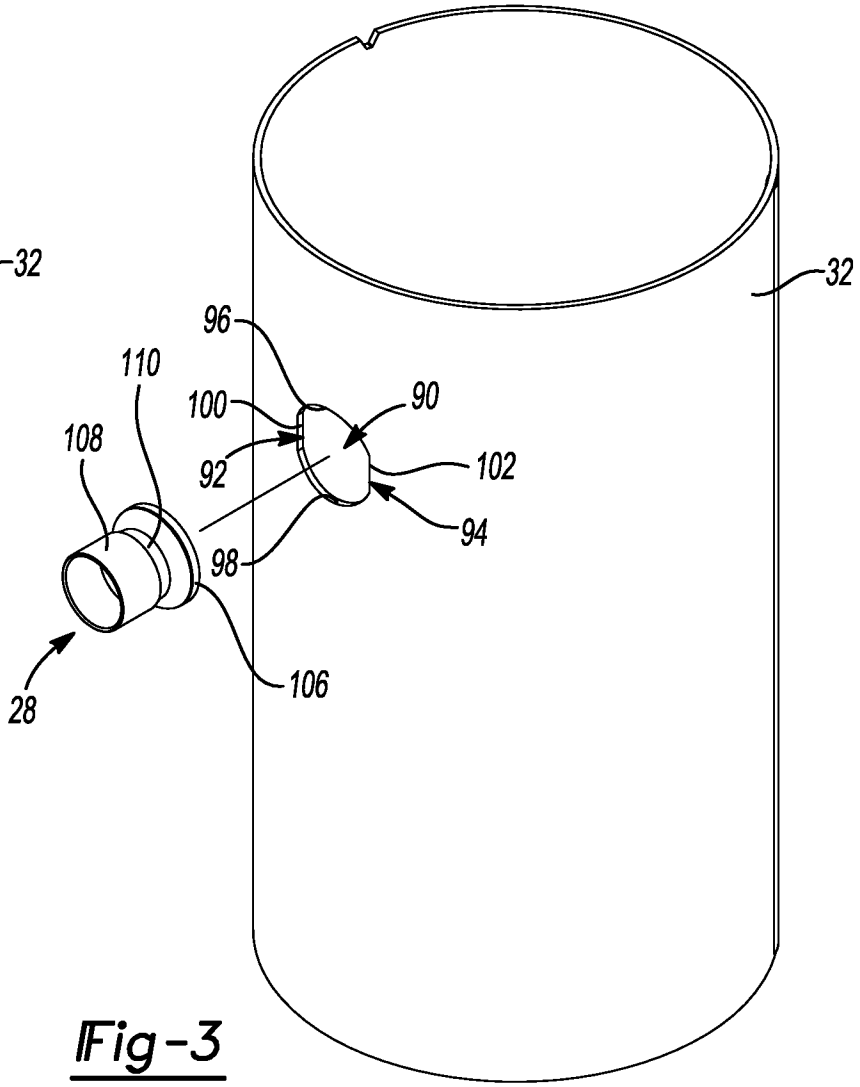
FIG. 3 is a perspective view of the shell of the compressor of FIG. 1 with the suction fitting exploded therefrom.
Figure 2:
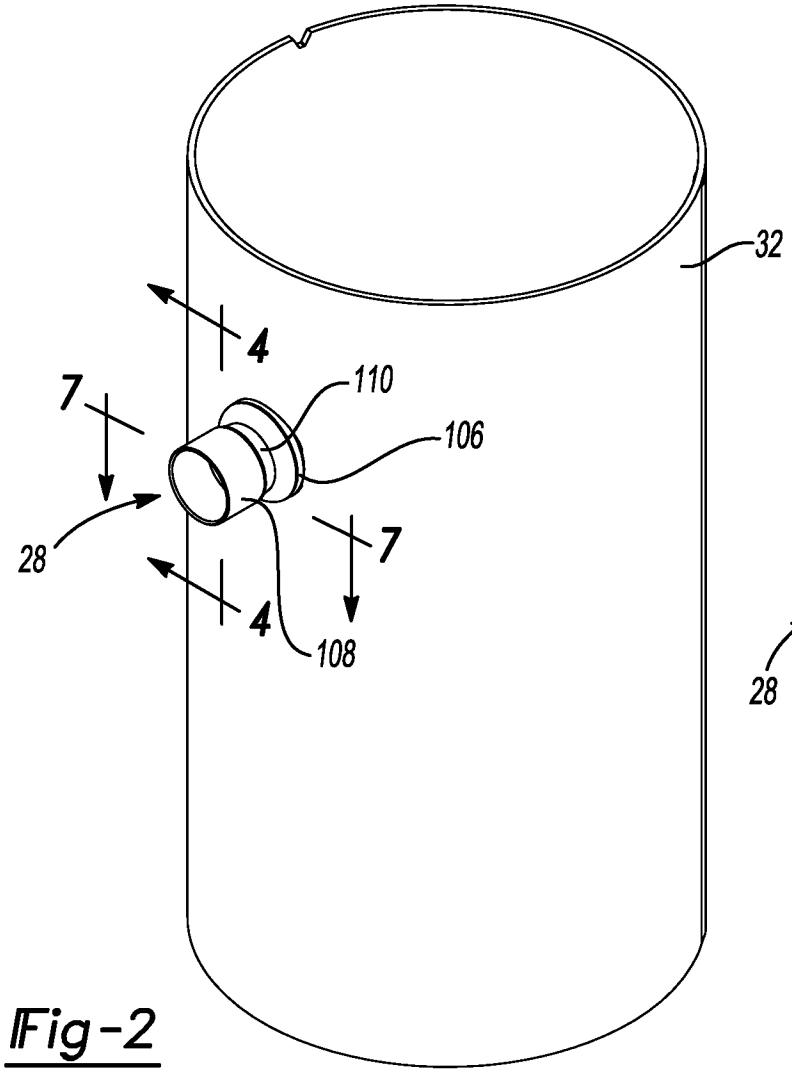
FIG. 2 is a perspective view of a shell of the compressor of FIG. 1 with the suction fitting attached thereto.
Figure 4:
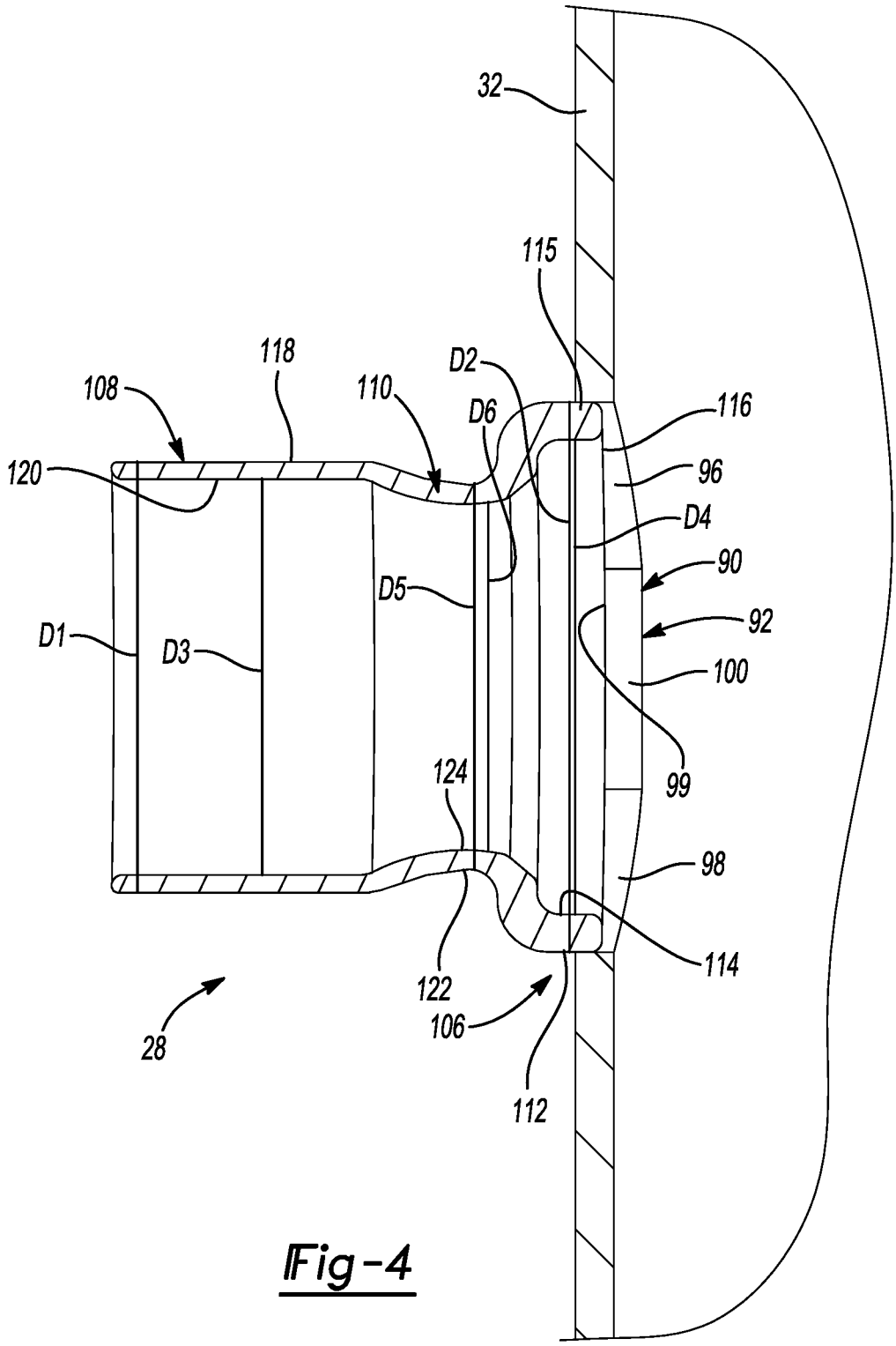
FIG. 4 is a cross-sectional view of the shell of the compressor taken along line 4-4 of FIG. 2.
Figure 7:
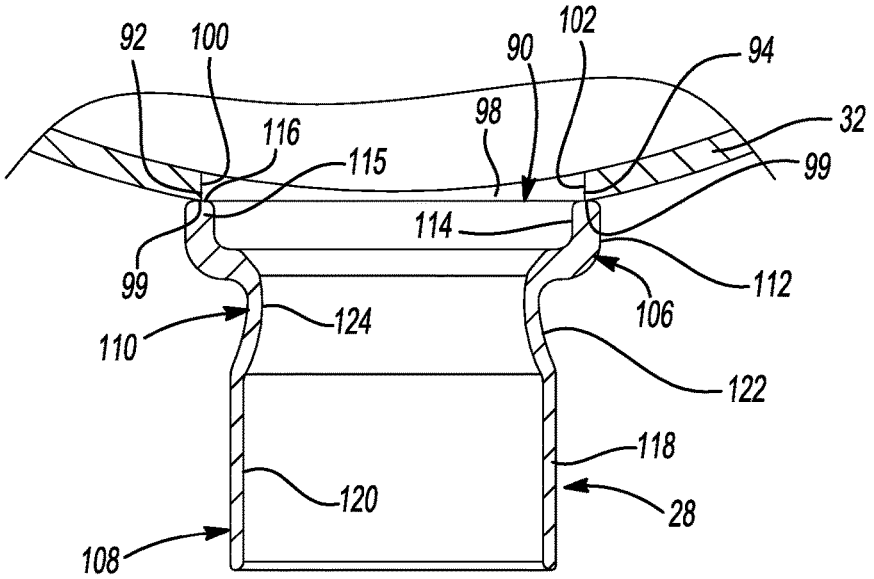
FIG. 7 is a cross-sectional view of the shell of the compressor taken along line 7-7 of FIG. 2.
Figure 8:
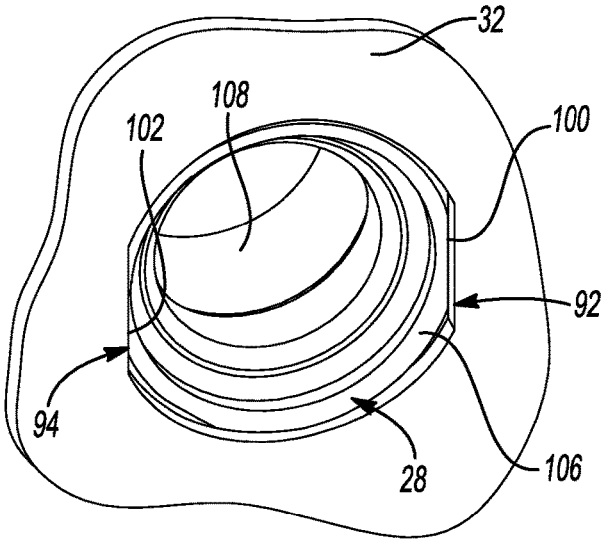
FIG. 8 is a partial perspective view of the shell of the compressor with the suction fitting attached thereto.
Figure 9:
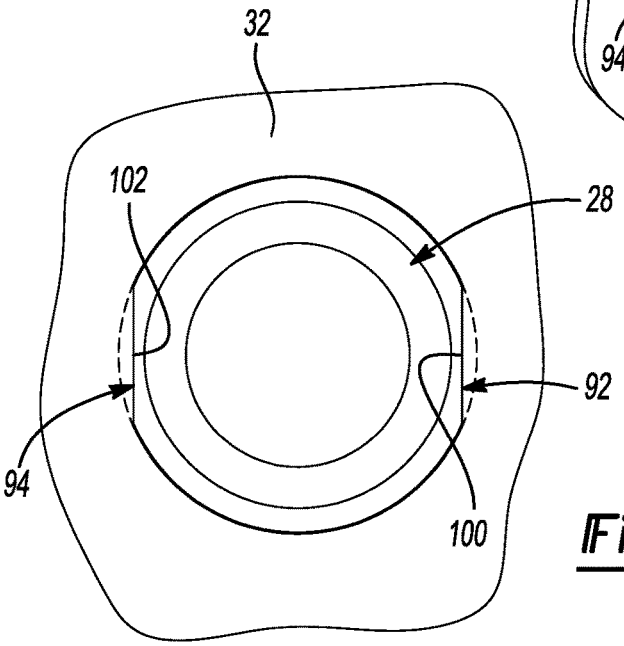
FIG. 9 is another partial perspective view of the shell of the compressor with the suction fitting attached thereto.

As shown in FIG. 3, the opening 90 may be a non-circular shape and may be defined by a first edge 92, a second edge 94, a first arcuate surface 96 and a second arcuate surface 98. As shown in FIGS. 4 and 7, the first and second edges 92, 94 prevent the suction fitting 28 from extending into the suction-pressure chamber 39. That is, the suction fitting 28 contacts each edge, 92, 94 at a location external to the opening 90 such that the suction fitting 28 is prevented from extending into the suction-pressure chamber 39. The first edge 92 may have a first planar surface 100 and the second edge 94 may oppose the first edge 92 and have a second planar surface 102. The second planar surface 102 may face the first planar surface 100. It should also be understood that the outer surfaces 99, proximate the first and second edges 92, 94, prevent the suction fitting 28 from contacting the first planar surface 100 and the second planar surface 102.

The first arcuate surface 96 and the second arcuate surface 98 are opposite each other and may cooperate with the first and second edges 92, 94 to define a circular shape. Each of the first and second arcuate surfaces 96, 98 are positioned between the first and second edges 92, 94 (FIGS. 3-5 and 7). As shown in FIG. 4, when the suction fitting 28 is received in the opening 90, the suction fitting 28 abuts against (i.e., contacts) the first and second arcuate surfaces 96, 98. In this way, the suction fitting 28 is prevented from moving in an axial direction (up or down relative to the shell 32) or in a tangential direction (side to side relative to the shell 32). A length of each of the first and second arcuate surfaces 96, 98 is greater than a length of each of the first and second planar surfaces 100, 102.

Figure 6:
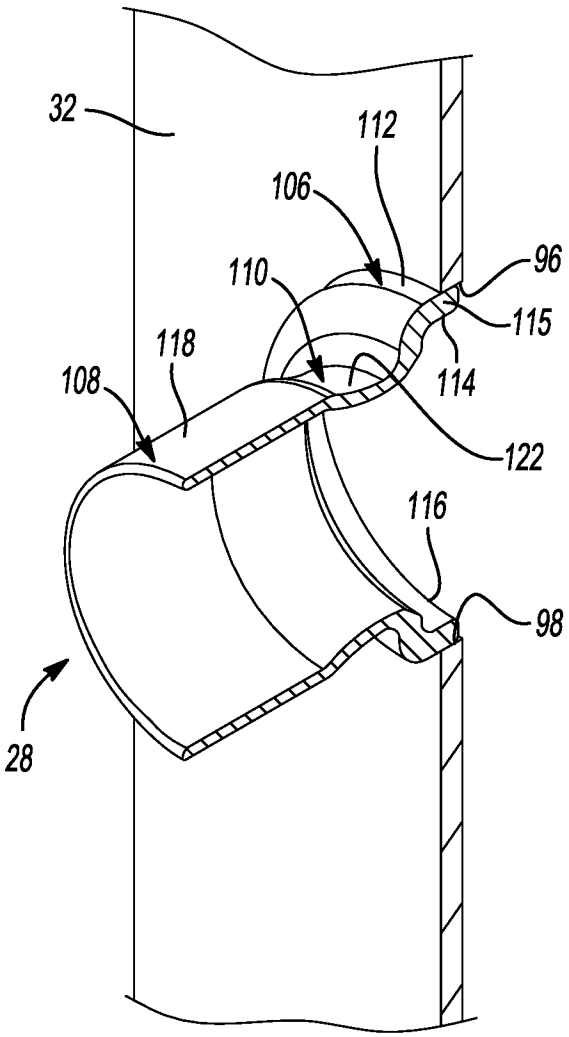
FIG. 6 is a partial cross-sectional view of the shell of the compressor with the suction fitting attached thereto.
Figure 5:
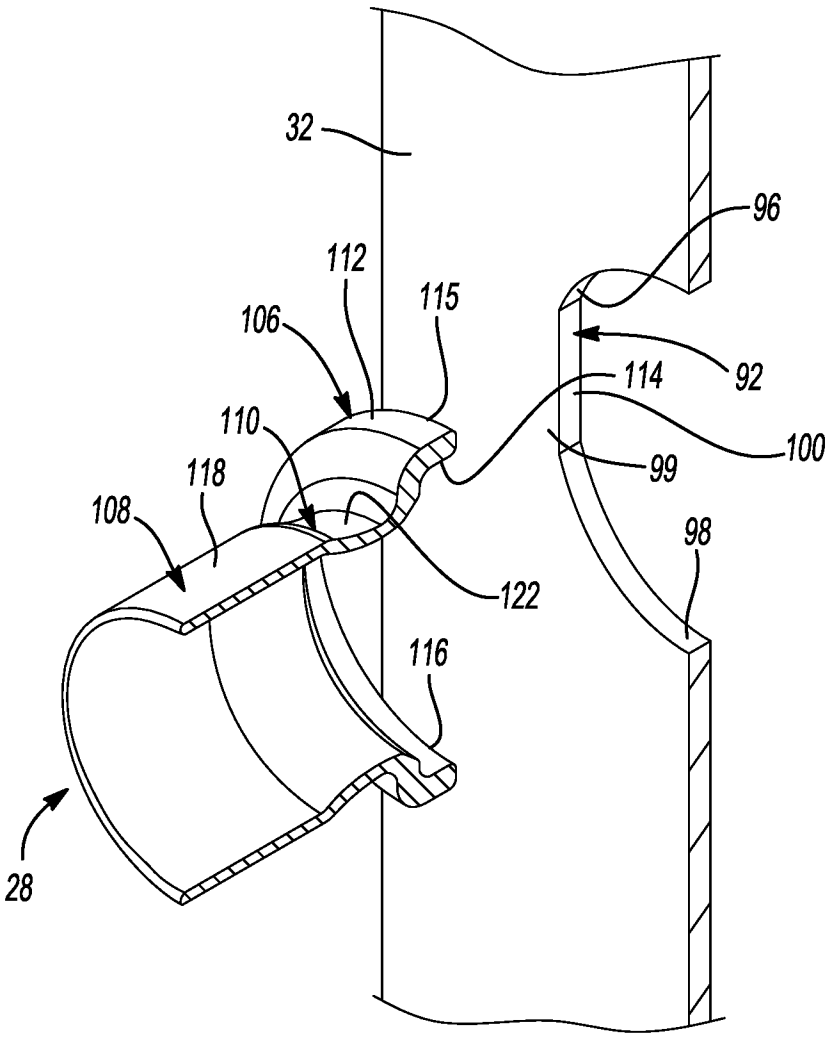
FIG. 5 is a partial cross-sectional view of the shell of the compressor with the suction fitting exploded therefrom.

The suction fitting 28 may include a shell-attachment section 106, a pipe-attachment section 108 and a transition section 110. The shell-attachment section 106 may have a thickness that is greater than a thickness of the pipe-attachment section 108 and a thickness of the transition section 110. The shell-attachment section 106 has a first outer diametrical surface 112 and a first inner diametrical surface 114. As shown in FIGS. 4 and 6, an axial end 115 of the shell-attachment section 106 is coupled to (i.e., welded) the shell 32 such that the first outer diametrical surface 112 contacts the first and second arcuate surfaces 96, 98 and an axial end surface 116 contacts the first and second edges, 92, 94 (at a location external to the opening 90). Stated differently, a portion of the axial end 115 of the shell-attachment section 106 extends at least partially into the opening 90 such that only a portion of the axial end surface 116 contacts the outer surfaces 99 of the edges 92, 94 and only a portion of the first outer diametrical surface 112 contacts the first and second arcuate surfaces 96, 98. The edges 92, 94 prevent the shell-attachment section 106 from extending through the opening 90 and into the suction-pressure chamber 39.

The pipe-attachment section 108 may be copper plated and may be attached to an external pipe (not shown) via brazing, for example, so that fluid flowing through the external pipe may flow to the compression pockets (via the suction fitting 28, the suction-pressure chamber 39 and the suction inlet 89). The pipe-attachment section 108 has a second outer diametrical surface 118 and a second inner diametrical surface 120. As shown in FIG. 4, a diameter D1 of the second outer diametrical surface 118 is smaller than a diameter D2 of the first outer diametrical surface 112. A diameter D3 of the second inner diametrical surface 120 is smaller than a diameter D4 of the first inner diametrical surface 114.

The transition section 110 is positioned between the shell-attachment section 106 and the pipe-attachment section 108 and has a third outer diametrical surface 122 and a third inner diametrical surface 124. A diameter D5 of the third outer diametrical surface 122 is smaller than the diameter D2 of the first outer diametrical surface 112 and the diameter D1 of the second outer diametrical surface 118. A diameter D6 of the third inner diametrical surface 124 is smaller than the diameter D4 of the first inner diametrical surface 114 and the diameter D3 of the second inner diametrical surface 120.

One of the benefits of the compressor 10 of the present disclosure is the suction fitting 28 having varying thicknesses facilitates attachment to both the shell 32 and the external pipe (not shown). That is, the thickness of the shell-attachment section 106 facilitates welding the suction fitting 28 and the shell 32 and the thickness of the pipe-attachment section 108 facilitates brazing the suction fitting 28 and the external pipe. Stated differently, it is advantageous for the shell-attachment section 106 of the suction fitting 28 to have a large thickness to facilitate welding the suction fitting 28 to the shell 32, and it is advantageous for the pipe-attachment section 108 of the suction fitting 28 to have a small thickness to facilitate brazing the suction fitting 28 to the external pipe. Another benefit of the compressor 10 of the present disclosure is the opening 90 of the shell 32 being defined at least partially by the first and second edges 92, 94 and the arcuate surfaces 96, 98 facilitates positioning of the suction fitting 28 relative to the shell 32 and facilitates attachment (i.e., welding) of the suction fitting 28 to the shell 32.

It should be understood that other fittings of the compressor 10 may be attached to a respective opening in the shell assembly 12 having similar or identical features or characteristics of the opening 90 that the suction fitting 28 is attached to. For example, the discharge fitting 24 and/or a fluid-injection fitting (a fitting that provides working fluid directly to an intermediate position of the compression pockets) may be attached to the shell assembly 12 at a respective opening partially defined by opposing edges similar or identical to the edges 92, 94 and/or opposing arcuate surfaces similar or identical to the arcuate surfaces 96, 98. In other words, the discharge fitting 24 and/or fluid-injection fitting could have features similar or identical to the suction fitting 28 described above and shown in the figures, and the discharge fitting 24 and/or fluid-injection fitting could be attached to the shell assembly 12 at respective openings similar or identical to the opening 90.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell including an opening and defining a chamber;

a compression assembly disposed within the chamber of the shell; and a fitting attached to the shell at the opening, working fluid flowing through the fitting flows to the compression assembly, wherein the opening is partially defined by a first edge and a second edge, the first edge includes a first planar surface and the second edge includes a second planar surface that faces the first planar surface, a first portion of the fitting extends at least partially into the opening and a second portion of the fitting abuts against the first and second edges.

2. The compressor of claim 1, wherein the opening is a non-circular shape.

3. The compressor of claim 1, wherein the opening has opposing arcuate surfaces, and wherein an outer diametrical surface of the fitting abuts against at least one of the opposing arcuate surfaces.

4. The compressor of claim 3, wherein the opposing arcuate surfaces and the first and second edges cooperate to define a circular shape.

5. The compressor of claim 1, wherein the fitting is a suction fitting, and wherein working fluid flowing through the suction fitting flows to the compression assembly.

6. The compressor of claim 1, wherein the first portion of the fitting is a first portion of an axial end surface of the fitting and the second portion of the fitting is a second portion of the axial end surface of the fitting.

7. The compressor of claim 1, wherein the opening has opposing arcuate surfaces, and wherein the opposing arcuate surfaces and the first and second edges cooperate to define a rounded shape.

8. The compressor of claim 1, wherein the opening has opposing arcuate surfaces, and wherein each of the first and second edges are disposed between the opposing arcuate surfaces.

9. The compressor of claim 1, wherein the second portion of the fitting abuts against the first and second edges to prevent an outer diametrical surface of the fitting from contacting the first and second planar surfaces.

10. The compressor of claim 1, wherein the second portion of the fitting abuts against the first and second edges to prevent the second portion of the fitting from extending into the chamber of the shell.

11. The compressor of claim 1, wherein the second portion of the fitting abuts against the first and second edges at a location external to the opening.

12. A compressor comprising:

a shell including an opening and defining a chamber;

a compression assembly disposed within the chamber of the shell; and a fitting attached to the shell at the opening and at least partially disposed outside of the shell, wherein working fluid flows between the fitting and the compression assembly, wherein the opening is partially defined by a first edge having a first planar surface, a second edge having a second planar surface, and an arcuate surface disposed between the first and second planar surfaces, and wherein the first and second edges prevent the fitting from contacting the first and second planar surfaces and allow the fitting to contact the arcuate surface.

13. The compressor of claim 12, wherein the opening has another arcuate surface that is opposite the arcuate surface, and wherein an outer diametrical surface of the fitting abuts against at least one of the opposing arcuate surfaces.

14. The compressor of claim 12, wherein a first portion of the fitting extends at least partially into the opening and a second portion of the fitting abuts against the first and second edges at a location external to the opening.

15. The compressor of claim 12, wherein the fitting includes a first axial end having a first thickness and a second axial end having a second thickness, the first thickness greater than the second thickness, and wherein the first axial end includes a first portion that extends at least partially into the opening and a second portion that contacts the first and second edges.

16. The compressor of claim 15, wherein the first axial end has a first outer diametrical surface and the second axial end has a second outer diametrical surface, and wherein a first diameter of the first outer diametrical surface is greater than a second diameter of the second outer diametrical surface.

17. The compressor of claim 16, wherein the fitting has a transition portion positioned between the first axial end and the second axial end and having a third outer diametrical surface, and wherein a third diameter of the third outer diametrical surface is smaller than the first and second diameters.

18. The compressor of claim 12, wherein the fitting is made of steel and has a first axial end and a second axial end, and wherein the first axial end is attached to the shell and the second axial end has a copper plating coating.

* * * * *